US008967579B2

(12) United States Patent
Tsai

(10) Patent No.: US 8,967,579 B2
(45) Date of Patent: Mar. 3, 2015

(54) ANGLE INCLINING STRUCTURE FOR A DESK

(75) Inventor: Chi-Cheng Tsai, Nantou (TW)

(73) Assignee: Sing Bee Enterprise Co., Ltd., Nantou (TW)

( * ) Notice: Subject to any disclaimer, the term of this patent is extended or adjusted under 35 U.S.C. 154(b) by 247 days.

(21) Appl. No.: 13/585,591

(22) Filed: Aug. 14, 2012

(65) Prior Publication Data

US 2014/0048671 A1 Feb. 20, 2014

(51) Int. Cl.
*A47G 29/00* (2006.01)

(52) U.S. Cl.
USPC ..... 248/371; 248/188.1; 248/188.2; 248/441.1; 248/446

(58) Field of Classification Search
USPC ..... 248/188.1, 188.2, 923, 370, 398, 446, 248/454, 455, 457, 371
See application file for complete search history.

(56) References Cited

U.S. PATENT DOCUMENTS

| | | | | | |
|---|---|---|---|---|---|
| 1,441,942 | A * | 1/1923 | Owen | 248/371 |
| 3,640,228 | A * | 2/1972 | Busse | 108/6 |
| 4,365,561 | A * | 12/1982 | Tellier et al. | 108/7 |
| 4,703,701 | A * | 11/1987 | Sema | 108/10 |
| 4,714,025 | A * | 12/1987 | Wallin et al. | 108/20 |
| 4,751,884 | A * | 6/1988 | Ball | 108/147 |
| 4,969,403 | A * | 11/1990 | Schwartz et al. | 108/147 |
| 5,370,063 | A * | 12/1994 | Childers | 108/147 |
| 5,598,788 | A * | 2/1997 | Jonker | 108/147 |
| 5,682,825 | A * | 11/1997 | Manner | 108/147 |
| 5,797,331 | A * | 8/1998 | Watt | 108/146 |
| 5,823,120 | A * | 10/1998 | Holmquist | 108/147 |
| 5,924,665 | A * | 7/1999 | Sweere et al. | 248/285.1 |
| 6,038,986 | A * | 3/2000 | Ransil et al. | 108/145 |
| 6,220,185 | B1 * | 4/2001 | Pontoppidan | 108/147 |
| 6,296,216 | B1 * | 10/2001 | Law et al. | 248/289.11 |
| 6,312,069 | B1 * | 11/2001 | Weng | 312/312 |
| 6,474,243 | B1 * | 11/2002 | Grohse | 108/10 |
| 6,691,626 | B2 * | 2/2004 | Warner | 108/145 |
| 6,796,536 | B1 * | 9/2004 | Sevier, IV | 248/121 |
| 6,929,228 | B2 * | 8/2005 | Whitaker et al. | 248/284.1 |
| 7,252,277 | B2 * | 8/2007 | Sweere et al. | 248/371 |
| 7,677,515 | B2 * | 3/2010 | Oddsen et al. | 248/274.1 |
| 8,065,966 | B1 * | 11/2011 | Bacon et al. | 108/145 |
| 8,312,820 | B2 * | 11/2012 | Rotlevi et al. | 108/50.01 |
| 8,661,989 | B2 * | 3/2014 | Tsai et al. | 108/10 |
| 2006/0065163 | A1 * | 3/2006 | Chi et al. | 108/7 |
| 2008/0028996 | A1 * | 2/2008 | Ooba et al. | 108/10 |
| 2009/0095868 | A1 * | 4/2009 | Ohlson | 248/371 |
| 2011/0168062 | A1 * | 7/2011 | Dellavecchia | 108/7 |

* cited by examiner

*Primary Examiner* — Monica Millner
(74) *Attorney, Agent, or Firm* — Alan D. Kamrath; Kamrath IP Lawfirm, P.A.

(57) ABSTRACT

An angle inclining structure for a desk contains a body and an angle inclining structure, the body including two opposite support legs, a horizontal rod, and two support posts connected with the two support legs and a first plate, wherein the angle inclining structure is disposed between the horizontal rod and the first plate and has a holder, a covering member, and a buffer member, the holder includes a locking tab and connects with the horizontal rod, a receiving room to receive a retainer and a pushing element, and a groove to receive a positioning member; the covering member includes a slot, plural tilted recesses, and a locking hole; a free end of the buffer member axially couples with one end of the covering member and a bottom surface of the first plate so that when the first plate axially rotates upwardly, the covering member slides on the holder.

6 Claims, 10 Drawing Sheets

ANGLE INCLINING STRUCTURE FOR A DESK

FIELD OF THE INVENTION

The present invention relates to an angle inclining structure, and more particularly to an angle inclining structure for a desk which has a slow descending function and a safe positioning function.

BACKGROUND OF THE INVENTION

A conventional angle inclining structure for a desk is capable of adjusting an inclined angle of a plate of a desk, but it does not have a descending function. Therefore, when a user is desired to move the plate back to an original position after the plate is moved upwardly, the plate is manually pressed downward by the user, yet noises generate and the user is clamped by the plate easily.

To obtain a descending purpose, a hydraulic rod of a buffer structure is fixed on a bottom end of the plate so that the plate is adjusted toward a desired angle and is descended slowly. However, the plate still can not be fixed safely.

The present invention has arisen to mitigate and/or obviate the afore-described disadvantages.

SUMMARY OF THE INVENTION

The primary object of the present invention is to provide an angle inclining structure for a desk which has a slow descending function and a safe positioning function.

Another primary object of the present invention is to provide an angle inclining structure for a desk which retracts the first plate quickly and prevents from clipping the user's fingers.

To obtain the above objectives, an angle inclining structure for a desk provided by the present invention contains:

a body and an angle inclining structure, the body including two opposite support legs, a horizontal rod fixed between the two opposite support legs, and two support posts connected with two top ends of the two support legs and a first plate, the angle inclining structure being disposed between the horizontal rod and the first plate; wherein the angle inclining structure is comprised of a holder, a covering member, and a buffer member, the holder includes a locking tab extending outwardly from one end thereof and axially connecting with the horizontal rod, a receiving room and a groove, both of which are defined on a top surface of the holder, and the receiving room is used to receive a retainer with a boss and a pushing element for pushing the retainer, the groove is applied to receive a positioning member;

the covering member includes a. slot, a plurality of tilted recesses communicating with the slot, the boss of the retainer is fixed in one of the plurality of tilted recesses, and the covering member also includes a locking hole defined thereon relative to the positioning member;

a free end of the buffer member axially couples with one end of the covering member and a bottom surface of the first plate so that when the first plate axially rotates upwardly, the covering member slides on the holder.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
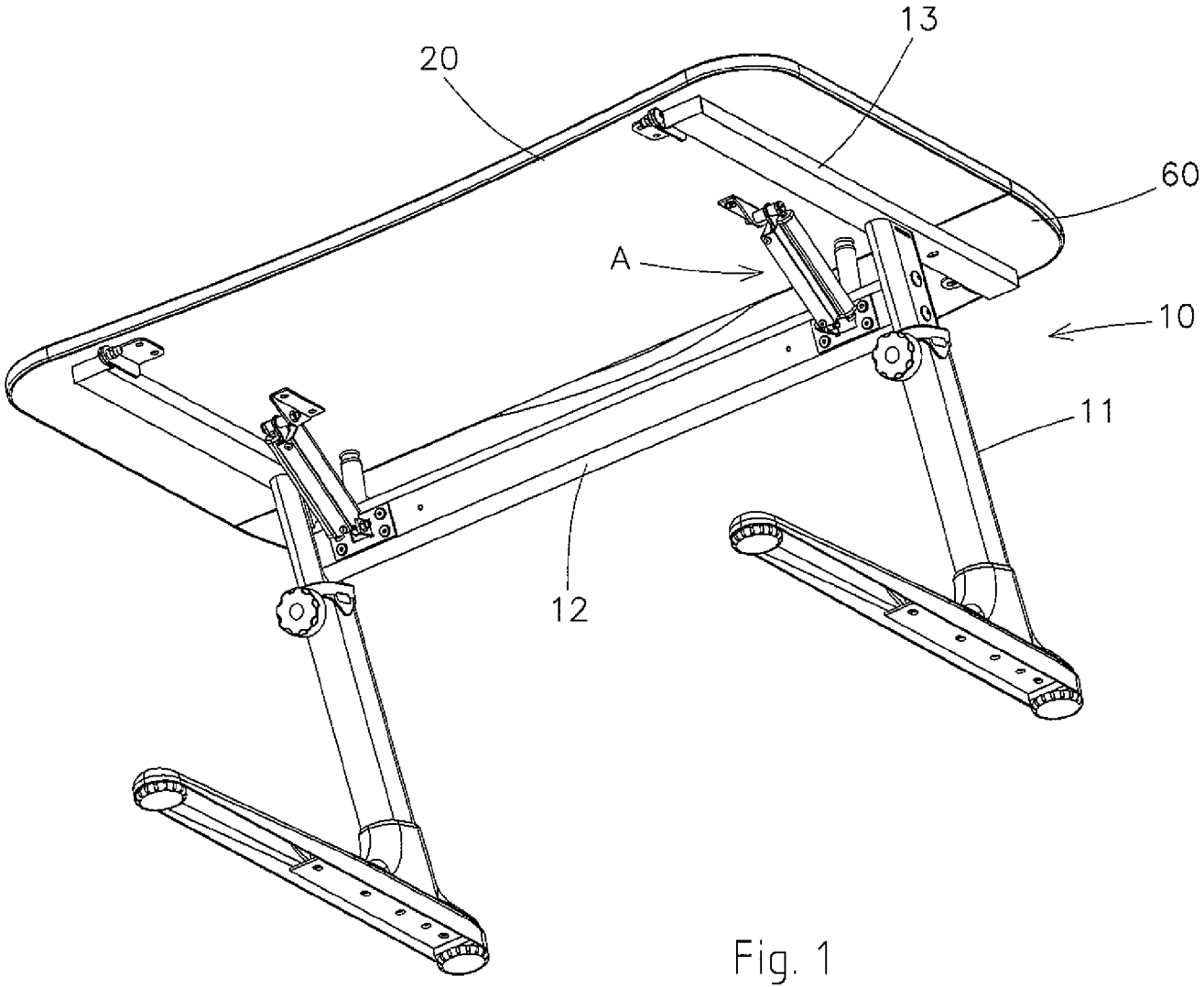
FIG. 1 is a perspective view showing the application of an angle inclining structure for a desk according to a preferred embodiment of the present invention.
Figure 2:
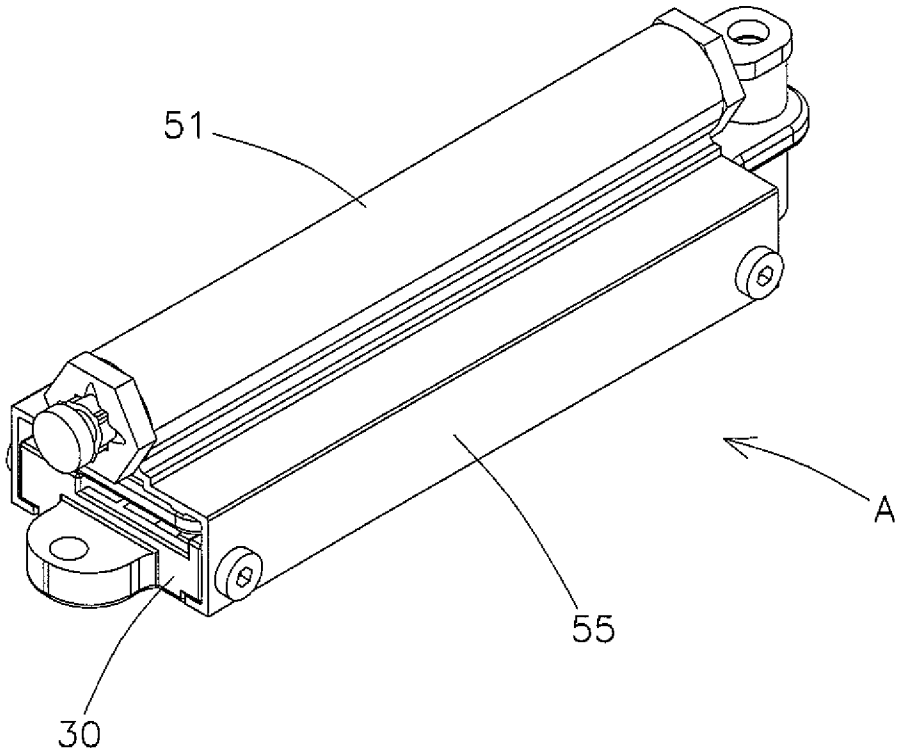
FIG. 2 is a perspective view showing the assembly of the angle inclining structure for the desk according to the preferred embodiment of the present invention.
Figure 3:
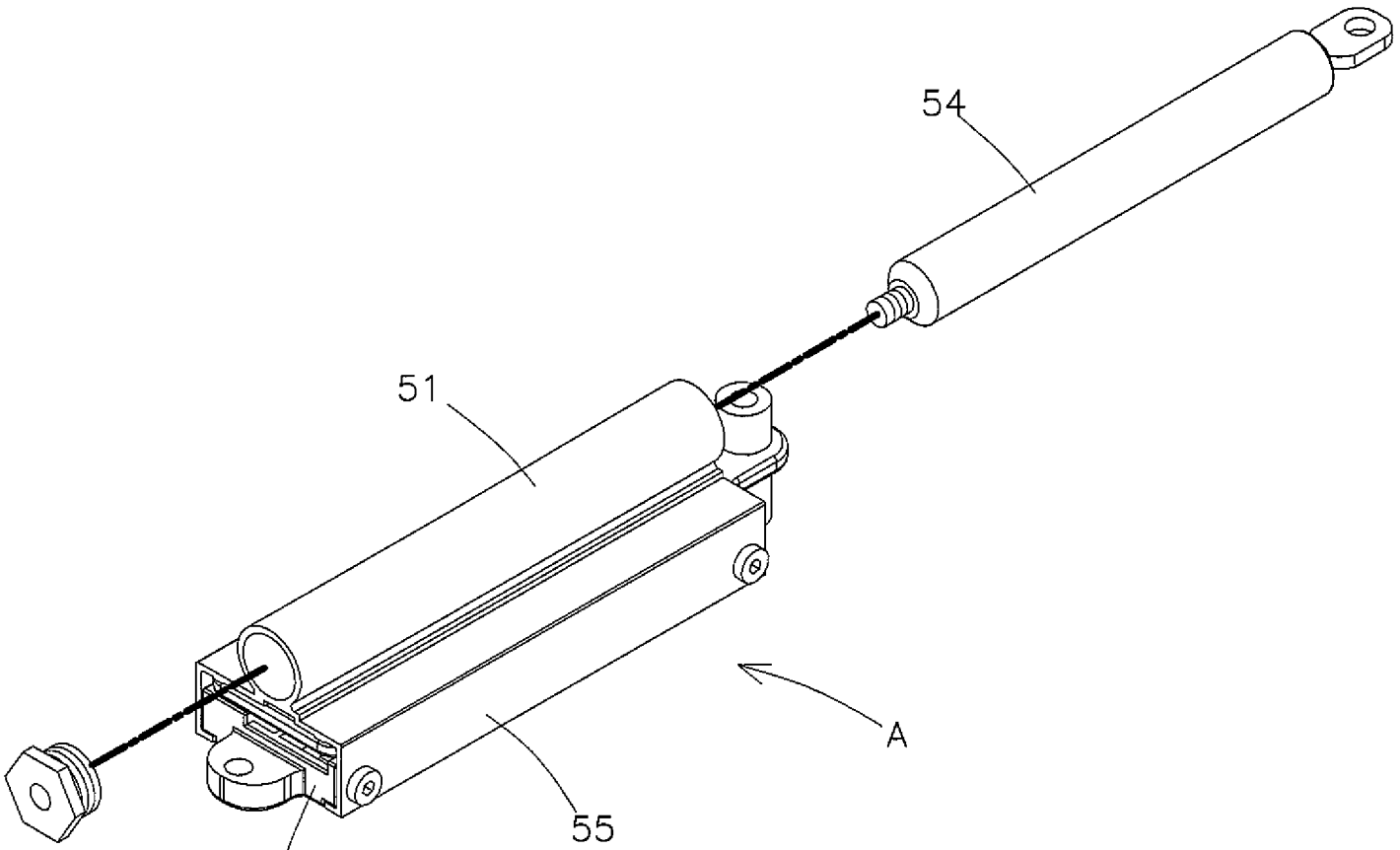
FIG. 3 is a perspective view showing the assembly of a part of the angle inclining structure for the desk according to the preferred embodiment of the present invention.
Figure 4:
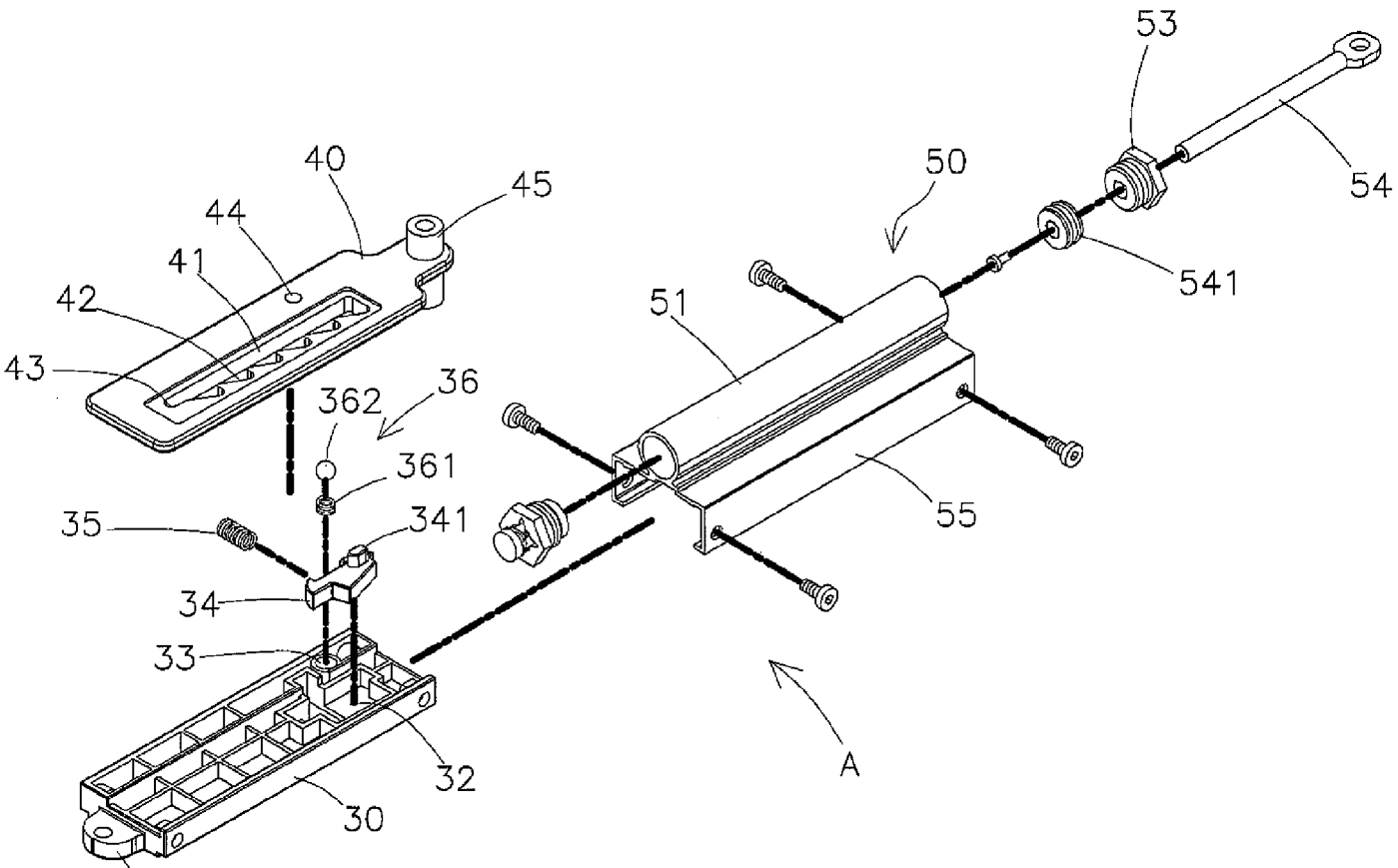
FIG. 4 is a perspective view showing the exploded components of the angle inclining structure for the desk according to the preferred embodiment of the present invention.
Figure 5:
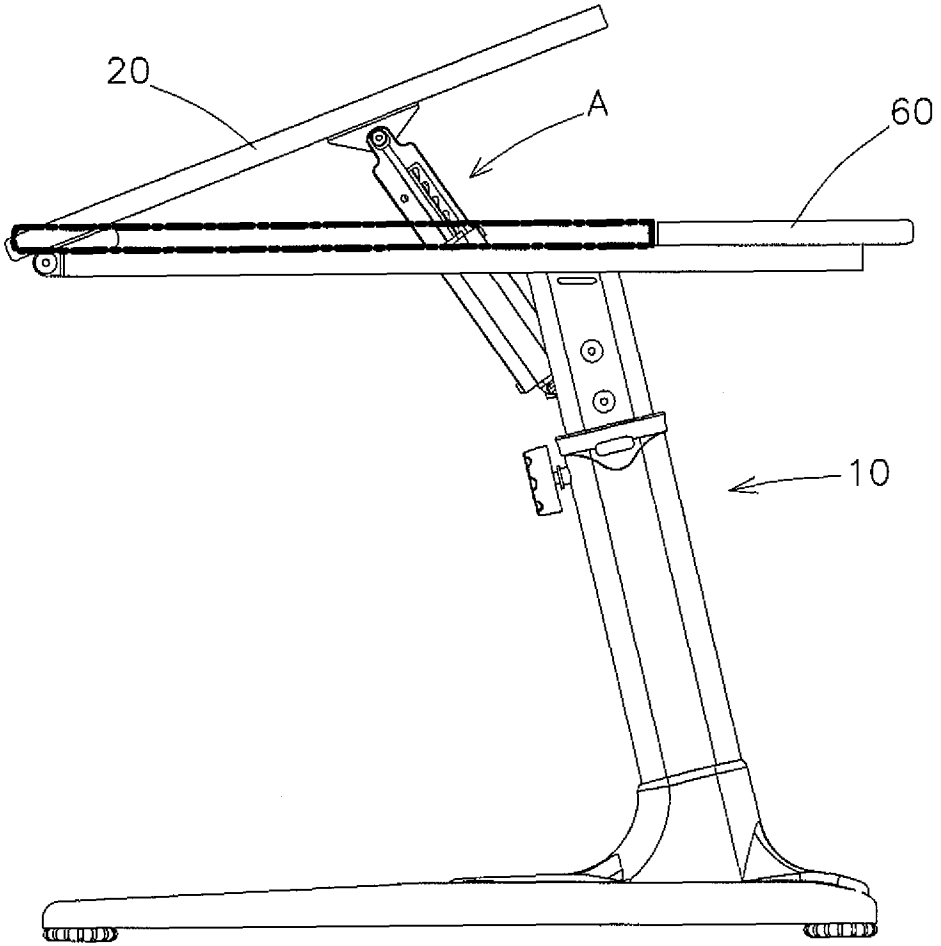
FIG. 5 is a plan view showing the operation of the angle inclining structure for the desk according to the preferred embodiment of the present invention.

FIGS. 1 to 10, an angle inclining structure for a desk comprises a body 10 and an angle inclining structure A. The body 10 includes two opposite support legs 11, a horizontal rod 12 fixed between the two opposite support legs 11, two support posts 13 connected with two top ends of the two support legs 11 and a first plate 20, wherein the angle inclining structure A is disposed between the horizontal rod 12 and the first plate 20.

It is to be noted that the angle inclining structure A is comprised of a holder 30, a covering member 40, and a buffer member 50. The holder 30 includes a locking tab 31 extending outwardly from one end thereof and axially connecting with the horizontal rod 12, a receiving room 32 and a groove 33, both of which are defined on a top surface of the holder 30, wherein the receiving room 32 is used to receive a retainer 34 with a boss 341 and a pushing element 35 for pushing the retainer 34, and the groove 33 is applied to receive a positioning member 36.

The covering member 40 includes a slot 41, a plurality of tilted recesses 42 communicating with the slot 41, a limiting portion 43 defined on one side of the slot 41 relative to the locking tab 31, wherein the covering member 40 is mounted on a top surface of the holder 30 so that the boss 341 of the retainer 34 is fixed in the limiting portion 43, and the covering member 40 also includes a locking hole 44 defined thereon relative to the positioning member 36 so as to lock the positioning member 36 and includes a peg 45 extending outwardly from one end thereof adjacent to another end of the slot 41.

A free end of the buffer member 50 axially couples with the peg 45 and a bottom surface of the first plate 20 so that when the first plate 20 axially rotates upwardly, the covering member 40 slides on the holder 30.

The buffer member 50 is comprised of a tube 51, an adjusting valve 52, a screw bolt 53, a push stem 54 with a sealing plug 541, and a frame 55. One end of the tube 51 connects with the adjusting valve 52, and another end of the tube 51 couples with the screw bolt 53, the push stem 54 is fixed in the tube 51 so as to extend out of or retract into the tube 51, and the frame 55 is mounted on two peripheral sides of the tube 51 to receive the holder 30 and the covering member 40, wherein the holder 30 is connected with the frame 55, the pushing element 35 is a spring, and the positioning member 36 is comprised of a spring 361 and a ball 362.

The angle inclining structure further comprises a second plate 60 secured on two top ends of the two support posts 13 adjacent to the first plate 20.

The buffer member 50 is a pneumatic cylinder or a hydraulic cylinder.

Figure 6:
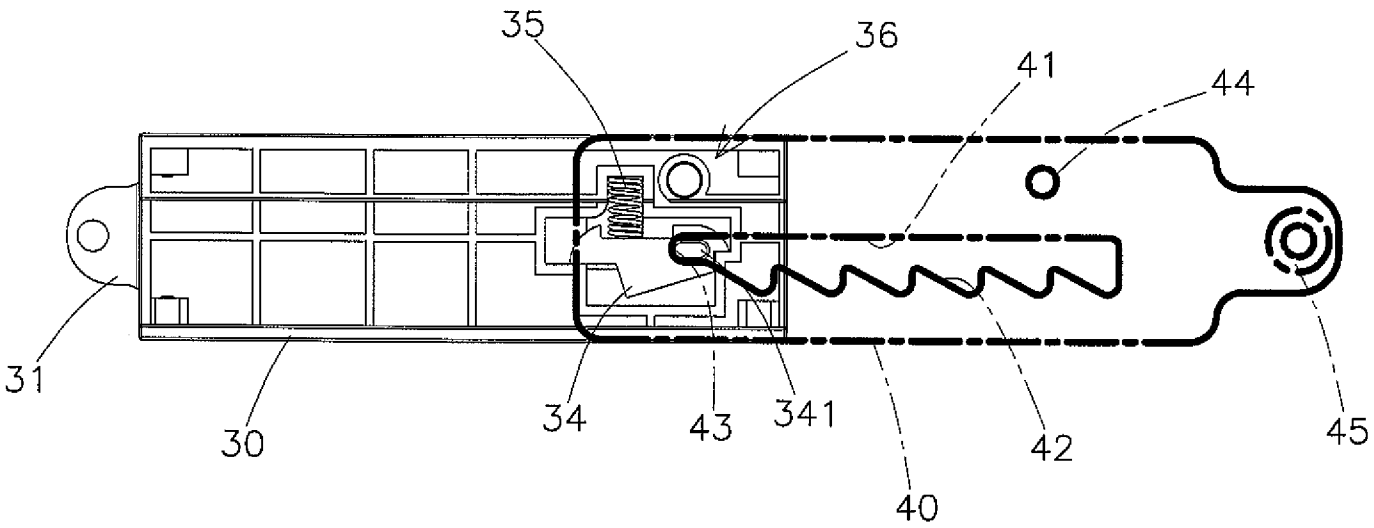
FIG. 6 is another plan view showing the operation of the angle inclining structure for the desk according to the preferred embodiment of the present invention.
Figure 7:
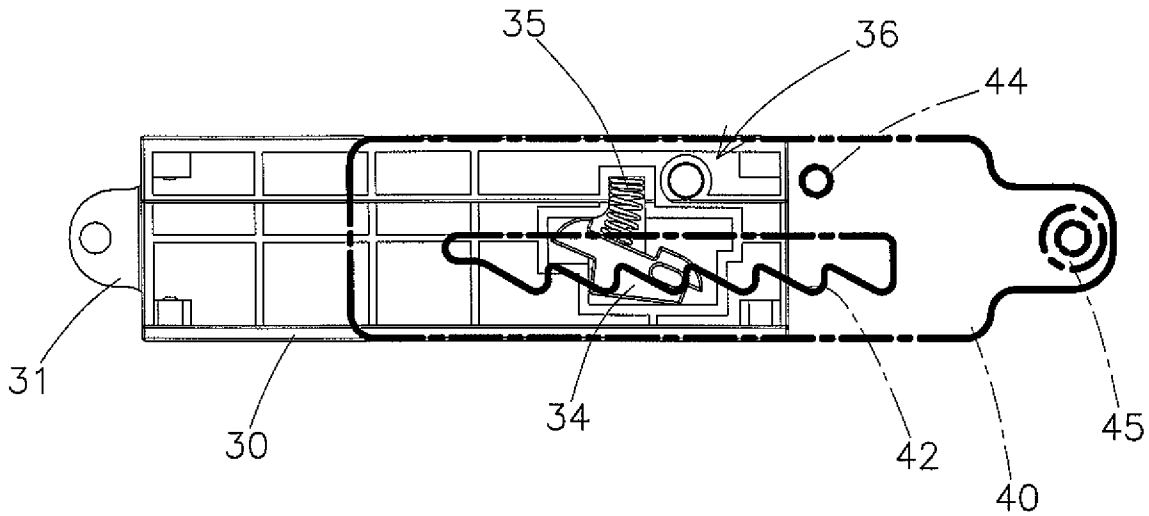
FIG. 7 is still a plan view showing the operation of the angle inclining structure for the desk according to the preferred embodiment of the present invention.
Figure 8:
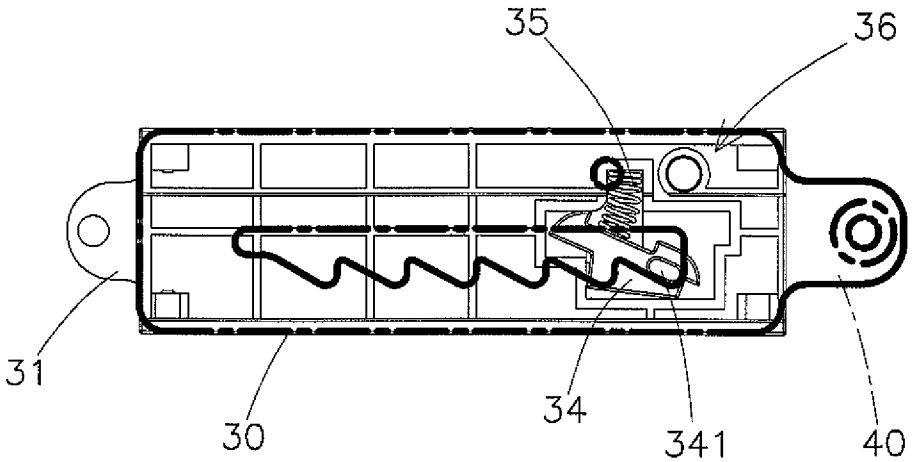
FIG. 8 is also a plan view showing the operation of the angle inclining structure for the desk according to the preferred embodiment of the present invention.

Referring to FIGS. 1 to 10, as desiring to adjust an tilted angle of the first plate 20, the first plate 20 is pulled upwardly so that the covering member 40 and the push stem 54 are driven simultaneously, then the positioning member 36 disengages from the locking hole 44 of the covering member 40 so that the boss 341 of the retainer 34 retains with the limiting portion 43 of the covering member 40 (as shown in FIG. 6). In the meantime, the first plate 20 tilts at a largest angle or at a desired angle adjusted by a user. In other words, when the first plate 20 is adjusted to tilt at the desired angle adjusted by the user, the boss 341 of the retainer 34 retains with one of the plurality of tilted recesses 42 (as illustrated in FIG. 7), hence not only the angle of the first plate 20 is adjusted randomly, but also the retainer 34 is pushed by the pushing element 35 to position the first plate 20 securely, thereby adjusting and positioning the first plate easily.

Figure 9:
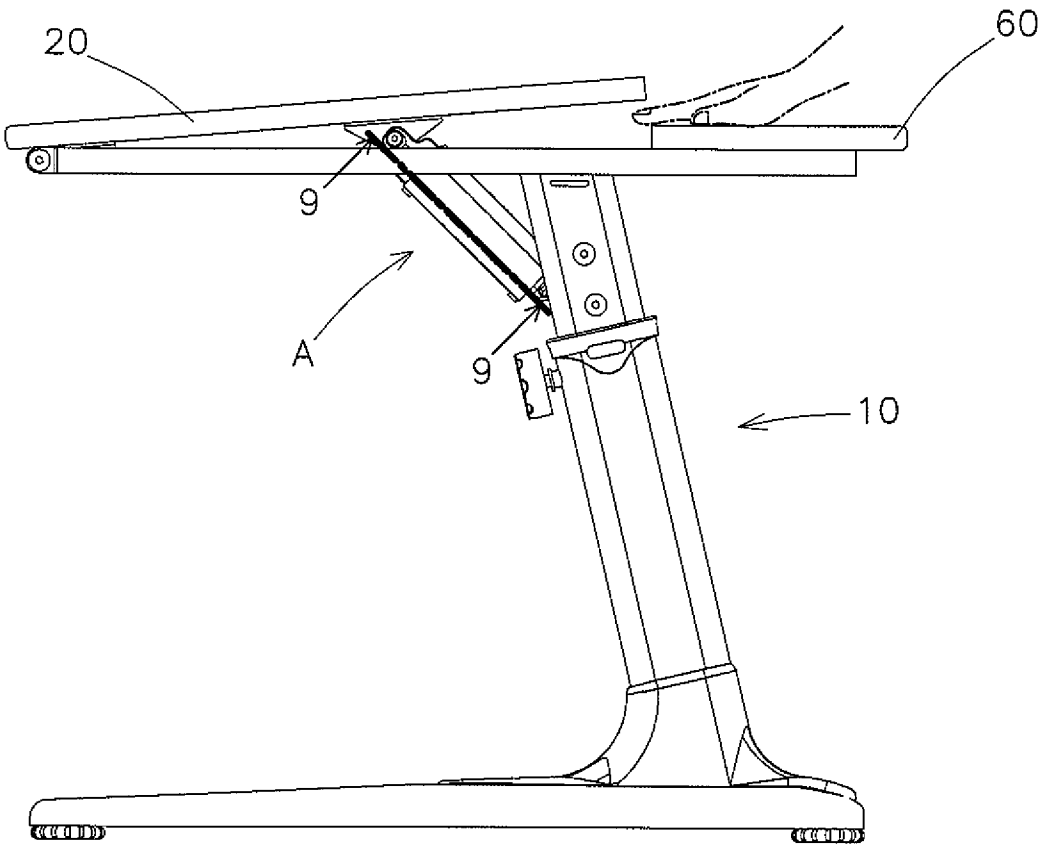
FIG. 9 is a plan view showing the operation of the angle inclining structure for the desk according to the preferred embodiment of the present invention.
Figure 10:
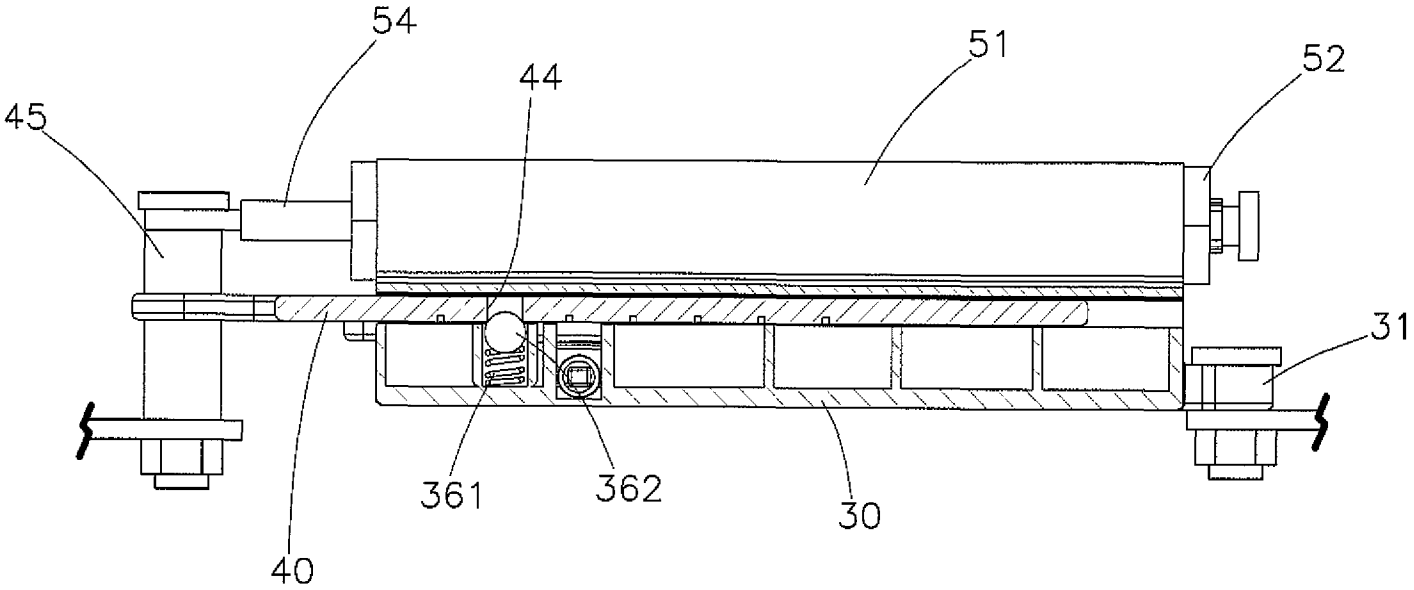
FIG. 10 is a cross sectional view taken along the lines 9-9 of FIG. 9.

As desiring to retracting of the first plate 20, the first plate 20 is pulled upwardly further and then is released so that the first plate 20 moves downward by ways of its weight, and then the buffer member 50 produces a descending effect to descend the first plate 20 slowly, such that an anti-clamp angle produces between the first plate 20 and the second plate 60 (as shown in FIG. 9). In other words, the first plate 20 is stopped descending to prevent from clamping the user's finger. Thereafter, the first plate 20 is further pressed downwardly so as to be parallel to the second plate 60, and the positioning member 36 retains in the locking hole 44 of the covering member 40 (as illustrated in FIG. 10), thereby retracting the first plate quickly and preventing from clipping the user's fingers.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An angle inclining structure for a desk comprising:

a body and an angle inclining structure, the body including two opposite support legs, a horizontal rod fixed between the two opposite support legs, and two support posts connected with two top ends of the two support legs and a first plate, the angle inclining structure being disposed between the horizontal rod and the first plate; wherein the angle inclining structure is comprised of a holder, a covering member, and a buffer member, the holder includes a locking tab extending outwardly from one end thereof and axially connecting with the horizontal rod, a receiving room and a groove, both of which are defined on a top surface of the holder, and the receiving room receives a retainer with a boss and a pushing element for pushing the retainer, the groove receives a positioning member;

the covering member includes a slot, a plurality of tilted recesses communicating with the slot, the boss of the retainer is fixed in one of the plurality of tilted recesses, and the covering member also includes a locking hole defined thereon relative to the positioning member;

a free end of the buffer member axially couples with one end of the covering member and a bottom surface of the first plate so that when the first plate axially rotates upwardly, the covering member slides on the holder;

the positioning member is comprised of a spring and a ball;

the covering member also includes a limiting portion defined on one side of the slot relative to the locking tab, and the covering member is mounted on a top surface of the holder so that the boss of the retainer is fixed in the limiting portion;

the covering member includes a peg extending outwardly from one end thereof adjacent to another end of the slot, and the free end of the buffer member axially couples with the peg and the bottom surface of the first plate.

2. The angle inclining structure for the desk as claimed in claim 1, wherein the buffer member is comprised of a tube, an adjusting valve, a screw bolt, a push stem with a sealing plug, and a frame; one end of the tube connects with the adjusting valve, and another end of the tube couples with the screw bolt, the push stem is fixed in the tube so as to extend out of or retract into the tube, and the frame is mounted on two peripheral sides of the tube to receive the holder and the covering member, wherein the holder is connected with the frame.

3. The angle inclining structure for the desk as claimed in claim 1, wherein the pushing element is a spring.

4. The angle inclining structure for the desk as claimed in claim 1 further comprising a second plate secured on two top ends of the two support posts adjacent to the first plate.

5. The angle inclining structure for the desk as claimed in claim 1, wherein the buffer member is a pneumatic cylinder.

6. The angle inclining structure for the desk as claimed in claim 1, wherein the buffer member is a hydraulic cylinder.

* * * * *